US006131939A

United States Patent [19]

Fels

[11] Patent Number: 6,131,939

[45] Date of Patent: Oct. 17, 2000

[54] SNOW SKI HAVING SLIDINGLY INTERCONNECTED UPPER AND LOWER SKI SECTIONS

[75] Inventor: David M. Fels, Ottawa, Canada

[73] Assignee: Fels Canadian Ski Company Ltd., Toronto, Canada

[21] Appl. No.: 09/135,037

[22] Filed: Aug. 17, 1998

[51] Int. Cl.[7] ..... A63C 5/00

[52] U.S. Cl. ..... 280/601; 280/602; 280/607; 280/608; 280/610; 280/617; 280/633; 280/636; 280/618

[58] Field of Search ..... 280/601, 602, 280/607, 609, 610, 608, 617, 633, 636, 618

[56] References Cited

U.S. PATENT DOCUMENTS

| | | | |
|---|---|---|---|
| 2,258,046 | 10/1941 | Clement . | |
| 3,099,025 | 7/1963 | Merkley et al. . | |
| 3,398,968 | 8/1968 | Mutzhas | 280/602 |
| 3,797,844 | 3/1974 | Smolka et al. | 280/607 |
| 4,221,400 | 9/1980 | Powers . | |
| 4,804,200 | 2/1989 | Kuchler . | |
| 5,248,160 | 9/1993 | Le Masson et al. . | |
| 5,249,819 | 10/1993 | Mayr | 280/609 X |
| 5,280,943 | 1/1994 | Commier et al. | 280/609 |
| 5,332,252 | 7/1994 | Le Masson et al. . | |
| 5,393,086 | 2/1995 | Le Masson et al. . | |
| 5,397,150 | 3/1995 | Commier et al. | 280/607 |
| 5,421,602 | 6/1995 | Stepanek et al. | 280/602 |
| 5,447,322 | 9/1995 | Le Masson et al. . | |
| 5,556,122 | 9/1996 | Arduin et al. | 280/602 |
| 5,806,875 | 9/1998 | Bonvallet | 280/602 |

*Primary Examiner*—Michael Mar
*Assistant Examiner*—Toan To
*Attorney, Agent, or Firm*—Trevor C. Klotz

[57] ABSTRACT

A snow ski of the type having separately constructed and joined together upper and lower elongate ski sections wherein the two sections are joined together by an elongate slide rail which slidingly interconnects the opposed faces of the upper and lower ski sections together. A connector arrangement is provided for captively holding the two sections together along the slide rail to thereby permit relative sliding movement between the upper and lower ski sections when the snow ski is flexed longitudinally. The lower ski section preferably is relatively thin and of uniform thickness between its ski tip and ski tail and is also uncambered. A camber is imparted to the lower ski section when it is slidingly interconnected to the upper ski section which itself on its lower surface is longitudinally curved. The upper ski section also preferably functions as a torsion tube and is more resistant to longitudinal flex and lateral twist than the lower section to which it is attached. Due to the novel way the two sections are interconnected, they can be readily separated and the bottom section replaced in the event it is damaged or if a skier desires a longer, shorter or wider lower ski section.

23 Claims, 4 Drawing Sheets

SNOW SKI HAVING SLIDINGLY INTERCONNECTED UPPER AND LOWER SKI SECTIONS

BACKGROUND OF INVENTION

This invention relates to a snow ski and has application to alpine skis, cross-country skis, snowboards and the like. More particularly, the snow ski of this invention is of the type which is made from separately constructed and joined together upper and lower elongate ski sections wherein the lower surface of the upper ski section overlies the top surface of the lower ski section between the ski tip and ski tail which is on the lower ski section.

An early example of skis employing separately constructed but joined together upper and lower ski sections is disclosed in U.S. Pat. No. 2,258,046 issued Oct. 7, 1941—Clement. As disclosed by Element, the elongate upper ski section, described as a reinforcing member, in the ski boot location or attachment area, is fixedly attached to the underlying lower ski section in the same area. That portion of the upper ski section forwardly and rearwardly of the boot fixation area, proximate its two free ends, is secured to the top surface of the lower ski section by means of arched clips attached to the top surface of the lower ski section so as to permit the relatively narrow free ends of the upper ski section, which extend through the clips, to undergo longitudinal sliding movement relative to the underlying lower ski section during longitudinal flexing of the ski.

More recently, Le Masson et al in U.S. Pat. Nos. 5,392,086 and 5,447,322 respectively issued on Feb. 28, 1995 and Sep. 5, 1995 have disclosed a number of different ski designs or configurations involving an upper ski section or "stiffener", which in U.S. Pat. No. 5,447,322 is disclosed as being attached to the underlying lower ski section or "beam" positively by a flexible interface constituted by a film of an elastic or viscose elastic material and/or a rigid connection which does not extend beneath the entire lower surface of the stiffener, and which in U.S. Pat. No. 5,393,086 discloses that the overlying stiffener is only attached at its front and rear ends to the lower ski section or base and that the fixation location for the ski boot is located above and not attached to the stiffener. Like Element, and as disclosed in the Le Masson et al references, the lower ski section, in side profile, is thicker in its medial area and is cambered along its longitudinal length. As a result, the lower surface of the associated upper ski section is shaped to match.

Both the upper reinforcing member as disclosed by Element and the "stiffener" of Le Masson et al are primarily intended to impart to the snow ski greater resistance to longitudinal flex. Their contribution to resisting torsional twisting of the snow ski is less significant, as the ski's ability to resist lateral twisting, particularly in the areas of the ski in front of and behind the ski boot fixation area, to a significant extent, is dictated by how the lower ski section or "beam" is constructed with this consideration in mind. Indeed, in U.S. Pat. Nos. 5,392,086 and 5,447,322 it is indicated the rigidity of the stiffener is less or only equal to that of the lower ski section or base.

SUMMARY OF THE INVENTION

As indicated above, the novel snow ski of this invention is of the type having separately constructed and joined together upper and lower elongate ski sections where the upper ski section overlies the lower ski section between the tip and the tail of the lower ski section. However, and unlike Element or Le Masson et al, the upper and lower ski sections are joined together in a novel manner, by employing connector means for slidingly interconnecting the two sections together and which preferably is in the form of at least one longitudinally extending slide rail or track that positively interconnects the opposed faces of the upper and lower ski sections together in sliding relationship.

By slidingly interconnecting the two ski sections together, a positive connection between the two sections is created along the length of the slide rail. At the assembly stage, this permits the two sections to be joined together in a quick and efficient manner, and also facilitates ease of separation of the two joined together sections if one of the sections is to be repaired or replaced with a substitute section. Further, due to the sliding relationship of the two joined together sections, an optimal flex curve in the longitudinal direction can be obtained, with no unwanted flat spots.

In a preferred form of construction, the slide rail which can be of any suitable cross section, such as an "I", is fixed to and has a portion which extends above and centrally along a top surface of the lower ski section. An elongate channel or slot, which in cross-section is configured so as to slidingly receive that portion of the slide rail above the lower ski section, is provided in and extends centrally along a lower surface of the upper ski section. As the tip and tail of the snow ski is carried by the lower ski section, the two sections are slidingly interconnected by introducing the slotted front end of the upper ski section to the rearmost portion of the slide rail carried by the lower ski section, proximate its tail.

In accordance with another aspect of this invention, the lower surface of the upper ski section is inwardly curved along its length so as to complement the top surface curvature of a cambered lower ski section which it overlies. As will be described in greater detail below, because the upper and lower ski sections are slidingly interconnected, the longitudinally curved lower surface of the upper ski section, which is relatively stiff, can also advantageously be used to impart a complimentary curvature or "camber" to an otherwise uncambered lower ski section as the two sections are joined together by the slide rail.

In keeping with another feature of this invention, the upper ski section itself can advantageously function as a torsion tube so as to effectively establish the flex profile (longitudinal flex and lateral twist) imparted to the lower ski section to which it is attached. Employing the upper ski section as a torsion tube has particular application to lower ski sections which are relatively thin and of substantially uniform thickness between at least the tip and tail of the ski, and which do not inherently exhibit much resistance to longitudinal flexing or lateral twisting. As a consequence, the resistance to longitudinal flexing, as well as lateral twisting near the tip and tail of the ski, can be determined by the design characteristics of the upper ski section when functioning as a torsion tube.

A lower ski section having a uniform flex profile can be inexpensively constructed from any suitable laminate. Additionally, the lower ski section between its ends can be made effectively flat (uncambered) so that no stresses are imparted on the laminates during manufacture. However, and as pointed out previously, a camber can be imparted to the otherwise flat and thin lower ski section due to the curved lower surface of the upper ski section when the upper and lower ski sections are slidingly joined together by the connector means which preferably is in the form of a rail connector. Due to the sliding interconnection between the upper and lower ski sections, and the different flex and construction of each section, ski vibrations are dampened, and which is a recognized unwanted characteristic common to many conventional beam skis.

It will be recognized that the cost of fabricating a thin lower ski section of uniform thickness, compared to "beam" skis, is relative inexpensive. When used in conjunction with the slide connector aspect of this invention, it is thus possible, employing a common upper ski section, to replace the lower section with an identical one if damaged, or to substitute it with one of a shorter or longer length, different width, or different side cut configuration, depending upon several variables, including snow conditions, and the skier's skiing ability.

The upper ski section when functioning as a torsion tube can be provided with front and rear intermediate sections and front and rear end sections which are respectively located forwardly and rearwardly of its ski boot fixation area. The front and rear intermediate sections can each have a portion which is raised relative to the boot fixation area and a width which is less than the width of the boot fixation area, while the front and rear end sections can each have at least a portion which has a width greater than the width of the front and rear intermediate sections. The upper ski section itself can be produced in different lengths which exhibit the same or different flex profiles, as desired. Further, the thickness or elevation of the upper ski section in the boot fixation area can itself be made of any desired height and which can be an important consideration, particularly to ski racers.

In order to maintain the upper ski section on the lower ski section in a desired position once the two sections have been slidingly interconnected, suitable means is provided for captively holding the two components together whilst enabling them to undergo relative sliding movement during longitudinal flexing of the ski. This can be achieved by physically joining the upper ski section, below its boot fixation area, directly to the lower ski section, employing for that purpose any suitable means such as screws. Additionally or alternatively, at least one and preferably both of the front and rear end sections of the upper ski section can be provided with limit means so that the relative sliding action between the upper and lower sections during longitudinal flexing of the ski can also be controlled.

In this regard, and in accordance with another aspect of the invention, the limit means can comprise an aperture in one and preferably, both of the end portions of the upper ski section, a pin which is fixed to and projects upwardly from the top surface of the lower ski section into the aperture, and restrictor means positioned between the pin and a sidewall of the aperture. The restrictor means can be made out of any suitable material and preferably is resilient.

The limit means itself can be designed to permit one to either effectively lock the upper and lower sections together at the location of the limit means, meaning the "locked" ski is far more resistant to longitudinal flex, or to unlock the limit means which allows the two ski sections to move relative to one another and which results in a ski which exhibits a "soft" longitudinal flex. As a result, the longitudinal flex pattern of the ski can be readily changed to meet the skier's dictates.

BRIEF DESCRIPTION OF THE DRAWINGS

The invention is illustrated by way of example in the accompanying drawings wherein.

DETAILED DESCRIPTION OF THE DRAWINGS

Referring firstly to FIGS. 1 through 6, the elongate upper ski section 1 is configured so as to function as a torsion box or tube for reasons which will be apparent from that which follows. The torsion box or tube can be constructed from any suitable material such as solid wood, wood laminate, glass fibre, or other materials including plastics and foams and various combinations thereof as is well known in the art.

Figure 2:
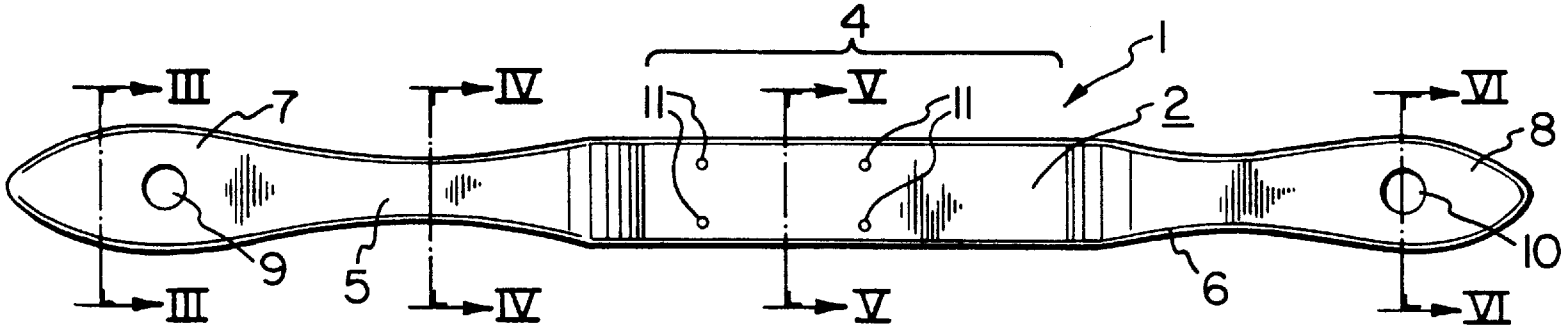
FIG. 2 is a top plan view of the upper ski section.
Figure 1:
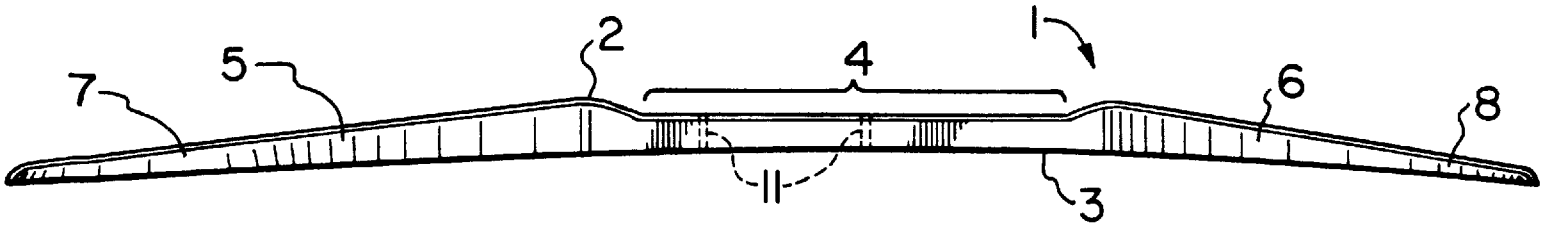
FIG. 1 is a side elevation view of the upper ski section.

As illustrated, the upper ski section is provided with an upper surface 2 and a lower surface 3 which is curved inwardly along its longitudinal length. With reference to FIGS. 1 and 2, the upper ski section 1 includes front end portion 7 and rear end portion 8, with front intermediate section 5 and rear intermediate section 6 respectively located between their associated end portions and ski boot fixation area 4. The width of intermediate sections 5 and 6 is less than that of the width of the boot fixation area 4 and front and rear end portions 7 and 8. As also best seen in FIG. 1, front and rear intermediate sections 5 and 6 adjacent ski boot fixation area 4, relative to curved lower surface 3, taper downwardly toward their respective front and rear end portions 7 and 8.

The particular upper ski section as illustrated in the accompanying drawings is one constructed from an exterior shell of suitable plastic material 12, such as fibreglass, formed so as to provide the upper and lower surfaces 2 and 3 of the upper ski section 1, as best seen in the sectional views of FIGS. 3 through 6. Also, interior of bottom surface 3 of shell 12 is a reinforcing insert 13, again constructed from any suitable material such as carbon fibre. Interior of shell 12 and extending virtually the full length of the upper ski section is a vertically aligned wood laminate 15 which functions as a central backbone for the upper ski section.

Figure 6:
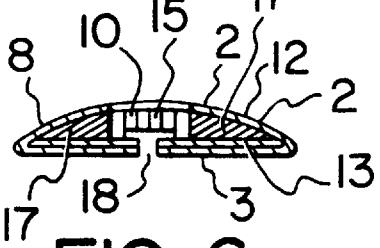
FIGS. 3, 4, 5, and 6 are sectional views of the upper ski section respectively taken along the lines III—III, IV—IV, V—V and VI—VI of FIG. 2.
Figure 5:
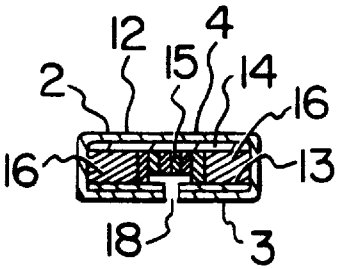
Figure 4:
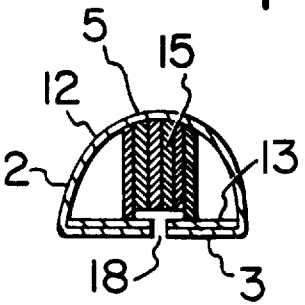
Figure 3:
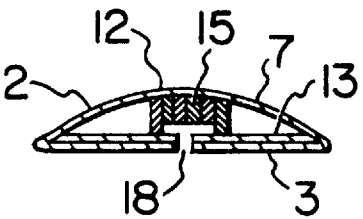

As seen in the sectional views of FIGS. 5 and 6, additional filler and/or strengthening material, such as wooden inserts 16 and 17, can be strategically located internally of shell 12 and laterally of the backbone 15. An additional reinforcing insert, 14 as also seen in FIG. 5, is positioned above backbone 15 and lateral insert pieces 16 in the boot fixation area 4.

For reasons which will be apparent from that which follows, the upper ski section can also include front and rear apertures 9 and 10, drill holes 11 for connecting the upper ski section to the lower ski section, and an elongate "T"-shaped channel section 18 which is provided in and extends centrally along the length of curved lower surface 3.

Figure 7:
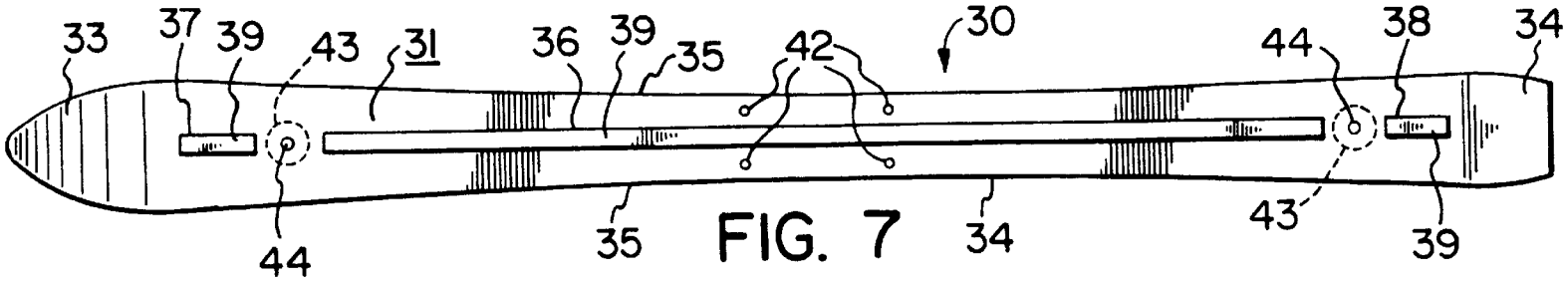
FIGS. 7 and 8 are respectively top plan views and side elevation views of the lower ski section and attached slide rails.
Figure 8:
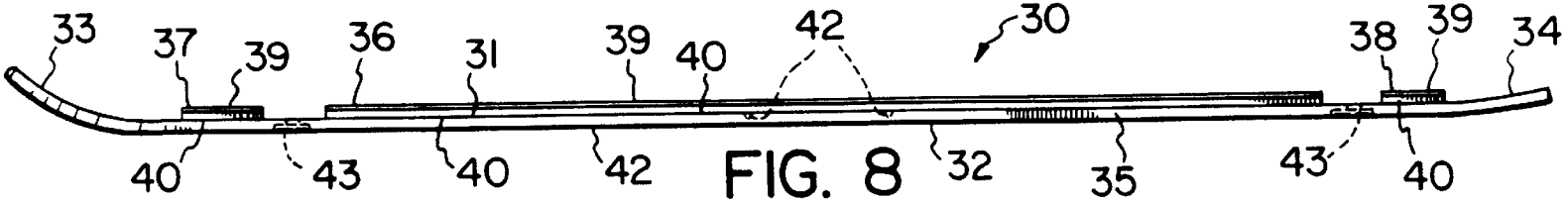
Figure 9:
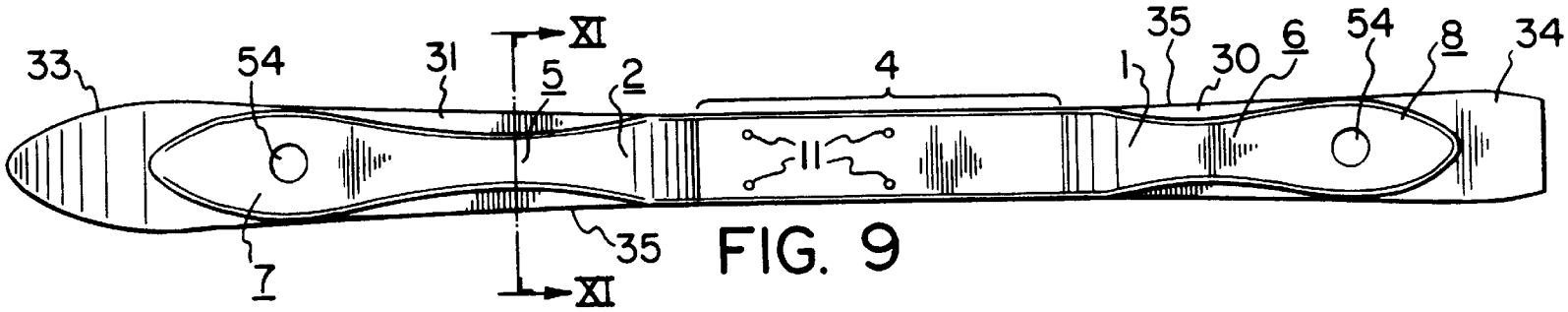
FIGS. 9 and 10 are respectively top plan and side elevation views of the upper and lower ski sections joined together.

Referring now to FIGS. 7 and 8, the lower ski section 30 as illustrated is provided with top surface 31, bottom surface 32, upwardly curved ski tip portion 33, ski tail portion 34, and inwardly curved sidewalls 35. While the foregoing is characteristic of conventional "beam" skis, in the embodiment illustrated it will be observed that the lower ski section is relatively thin and of uniform thickness along its length and that it is not longitudinally bowed or cambered. Indeed, and as indicated earlier, it is the upper ski section and not the lower ski section which is intended to dictate the overall flex profile of the snow ski.

Figure 11:
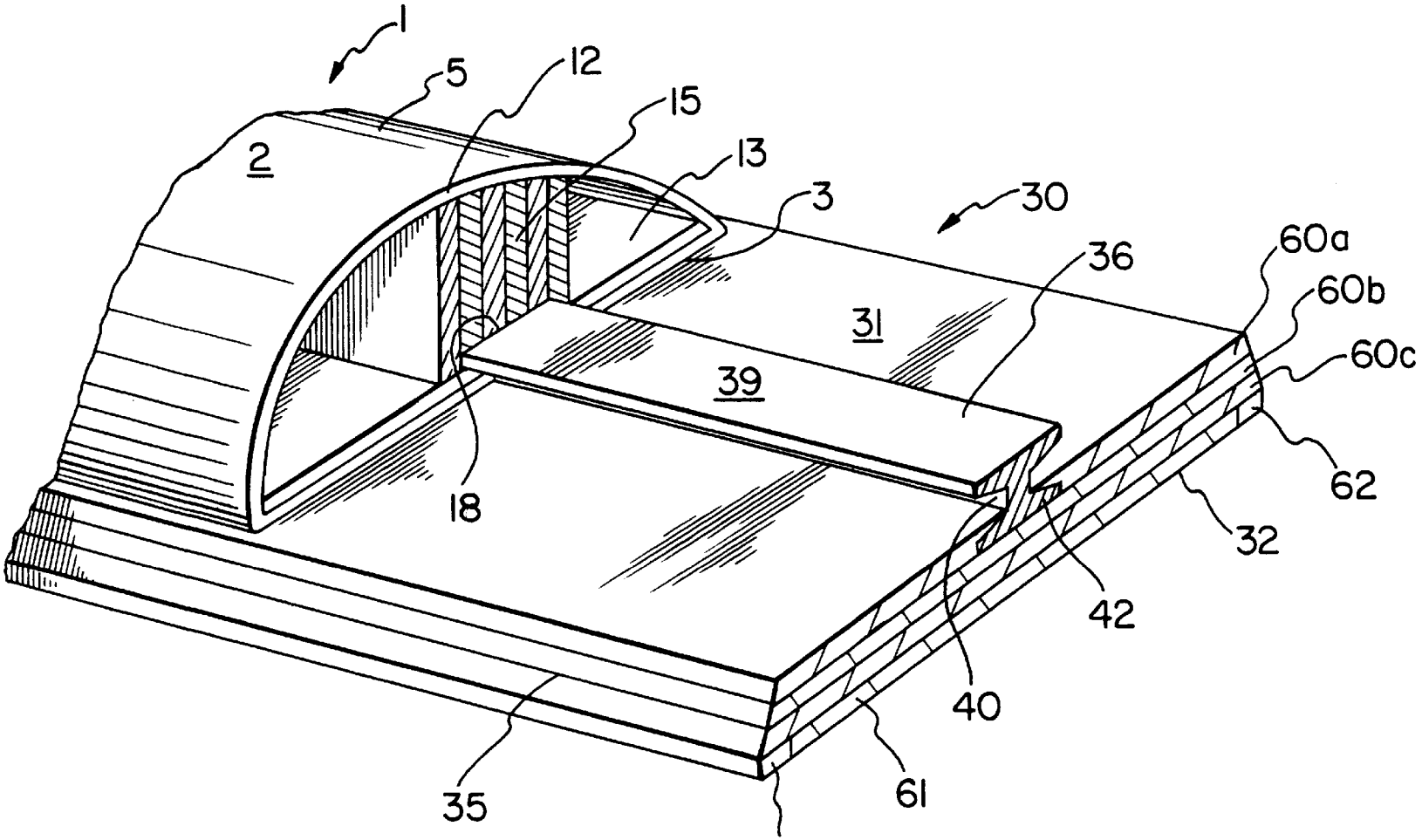
FIG. 11 is a three dimensional sectional view of the assembled upper and lower ski sections generally taken along the lines XI—XI of FIG. 9.

With reference to FIGS. 7, 8 and 11, the slide rail arrangement used to interconnect the upper and lower ski sections together, as shown in the drawings, consists of a central or main slide rail 36, a front slide rail 37 and a rear slide rail 38. The central as well as the front and rear slide rails are longitudinally aligned along the central top surface 31 of the lower ski section. As best seen in FIG. 11, rail portion 42 of slide rails 36, 37 and 38 is fixed to the lower ski section, with web 40 and top rail portion 39 of these three slide rails extending above top surface 31 so as to provide a "T"-shaped rail connection which is received in T-shaped section or channel 18 provided in the upper ski section.

As also best seen in FIG. 11, lower ski section 30 which is relatively thin and of uniform thickness between its tip and tail can be made up from laminates in a manner as is well known in the art. As illustrated, section 30 is made up from three joined together or laminated elongate pieces 60*a*, 60*b* and 60*c* as well as ski base 61, steel edges 62 and sidewalls 35. Rail portion 42 of slide rail 36 is fixed to section 30 below its top surface 31, with web 40 and rail portion 39 extending thereabove and which are slidingly received in the T-shaped slot or channel 18 provided in lower surface 3 of upper ski section 1.

Figure 10:
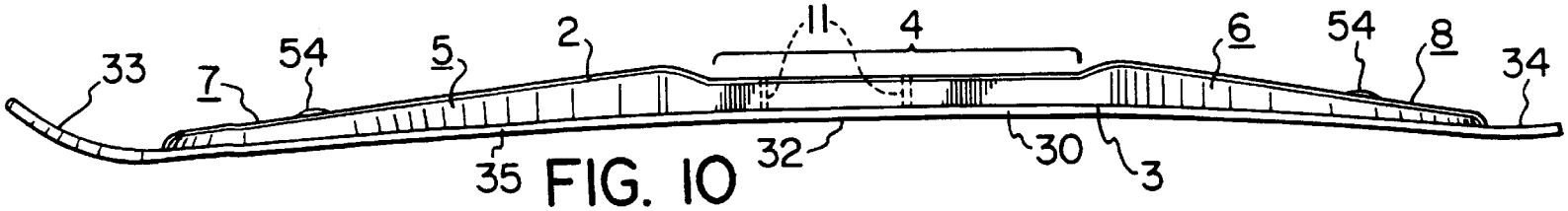

In order to slidingly interconnect upper ski section 1 to lower ski section 30, the open ended channel 18 in the front end portion of upper section 1 is caused to initially slidingly engage the rearmost portion of rear slide rail 38. As the two sections are slidingly interconnected together and because the upper ski section is stiff and curved in the longitudinal direction compared to the lower ski section, an upwardly directed curve or camber is imparted to that portion of the lower ski section 30 between its tip 33 and tail 34, as best seen in FIG. 10.

Once the upper and lower ski sections are slidingly interconnected in their desired relative position, the two sections are held captive on the slide rails. This can be achieved by joining the upper ski section in its ski boot fixation area 4 to the underlying lower ski section, employing for that purpose suitable attachment screws (not shown) which extend through holes 11 provided in the upper ski section and which are received in threaded holes 42 located therebelow in the lower ski section.

Figure 12:
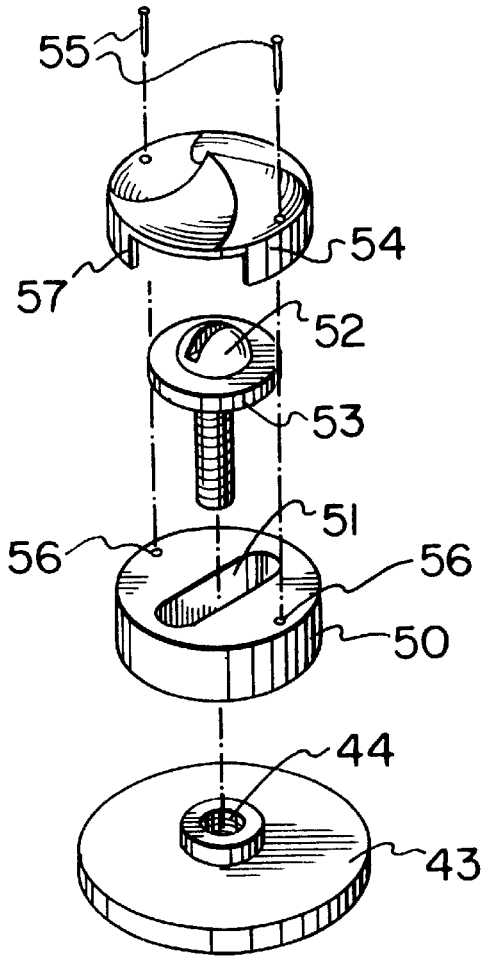
FIG. 12 is an exploded view of the limit means used to control the amount of relative sliding movement between the upper and lower ski sections.
Figure 13:
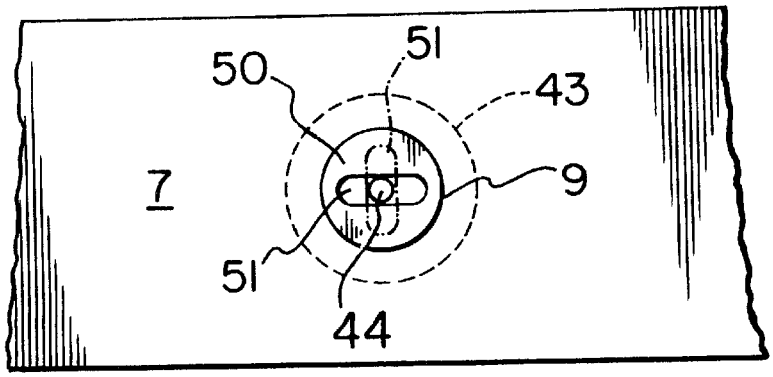
FIG. 13 is a segmented top plan view illustrating the two positions of the restrictor in the upper ski section.

In addition to the above, or alternatively, the two sections which are slidingly interconnected can be held captive on the slide means using limit means. The limit means illustrated in FIGS. 12 and 13 includes an anchor disk or plate 43 having a threaded hole 44 and which is integral with lower ski section 30 as best seen in FIGS. 7 and 8. Restrictor means 50 which as illustrated in FIG. 12 is in the form of a circular disk and which includes an elongate slot 51, is positioned in apertures 9 and 10 provided in the front and rear end portions 7 and 8 of the upper ski section 1. Threaded screw 52 having associated washer 53 extends through slot 51 and is threadedly connected to anchor disk 43. Cap 54 is attached to restrictor 50 by means of connector holes 56 in the restrictor and connector pins 55 which extend through the cap 54. By turning cap 54 and restrictor 50 which is connected to it, and as best seen in FIG. 13, the restrictor and its associated slot 51 can be moved from a position which is either in line or perpendicular to the longitudinal length of the ski. When the slot is in longitudinal alignment, or in other words the limit means is unlocked, the relative sliding action between the upper and lower sections is determined by the length of slot 51. Transverse slot 57 is provided in cap 54 so that it clears the head of screw 52 and washer 53 during sliding action. When in its position perpendicular to the length of the ski, the upper and lower ski sections are effectively locked together as no or only a very limited amount of relative movement is permitted to take place as screw 52 located in threaded hole 44 is in positive abutment with the sidewall of slot 51. In order to minimize the effect of an abrupt stop when the end of slot 51 hits pin 52 during longitudinal flexing of the ski, the restrictor means is preferably made of resilient material such as neoprene. Alternatively, the central portion of restrictor means 50 can be of solid material, such as aluminum, and surrounded by a resilient band so that the restrictor which includes the surrounding resilient band can be positioned in apertures 9 and 10 (not shown).

By turning cap 53, a skier without removing the skis is thus able to effectively lock the upper and lower ski sections together rendering the snow ski much stiffer or resistant to longitudinal flex when compared to the longitudinal flex profile of the snow ski when the two sections are not locked. It will also be apparent the flex profile can be altered. For example, the limit means on the front of the ski can be unlocked and the rear limit means locked, rendering a snow ski which has a soft flex front portion and a stiff flex rear portion.

What is claimed is:

1. In a snow ski of the type having separately constructed upper and lower elongate ski sections and in which the lower ski section includes top and bottom surfaces and a ski tip end and a ski tail end, and in which the upper ski section includes a ski boot fixation area intermediate elongate extent and having a lower surface which overlies in opposed relationship at a preselected location the top surface of said lower ski section between said ski tip and said ski tail, the improvement comprising at least one longitudinally extending slide rail which is fixedly and non-movably attached to and projects outwardly from and along one of said opposed top and lower surfaces and a corresponding longitudinally extending slide rail receiving channel projecting inwardly from and along the other of said opposed top and lower surfaces to permit sliding movement between said slide rail and said slide rail receiving channel, and to thereby permit said upper and lower ski sections to be slidingly interconnected, and means for fixedly attaching together at said ski boot fixation area said slidingly interconnected upper and lower ski sections when in said preselected location and to thereby permit relative sliding movement between said upper and lower ski sections along said slide rail when said snow ski is flexed longitudinally.

2. A snow ski of the type as claimed in claim 1, wherein said slide rail is attached to and projects outwardly from and along said top surface of said lower ski section.

3. A snow ski of the type as claimed in claim 2, wherein said separately constructed upper ski section relative to said separately constructed lower ski section is more resistant to longitudinal flex and lateral twist.

4. A snow ski of the type as claimed in claim 3, wherein the lower surface of said separately constructed upper ski section is inwardly curved along its length.

5. A snow ski of the type as claimed in claim 4, wherein the separately constructed lower ski section along its length between its ski tip and ski tail is uncambered and of substantially uniform thickness.

6. A snow ski of the type as claimed in claim 5, wherein a camber is imparted to said lower ski section when said upper and lower sections are slidingly interconnected.

7. A snow ski of the type as claimed in claim 2, wherein said upper ski section functions a torsion tube which has front and rear intermediate sections and front and rear end sections which are respectively located forwardly and rearwardly of said boot fixation area, each of said front and rear intermediate sections having at least a portion which is raised relative to said boot fixation area and a width which is less than the width of said boot fixation area, and each of said front and rear end sections having at least a portion which has a width greater than the width of said front and rear intermediate sections.

8. A snow ski of the type as claimed in claim 7 further including limit means located on at least one of said front and rear end sections of said upper ski section for selectively restricting the relative sliding movement between said upper and lower ski sections al said slide rail during longitudinal flexing of the snow ski.

9. A snow ski of the type as claimed in claim 8, wherein each said limit means comprises an aperture in said upper ski section, a pin which projects upwardly from the top surface of said lower ski section into said aperture, and restrictor means positioned between said pin and said aperture for restricting the relative movement of said pin within said aperture.

10. A snow ski of the type as claimed in claim 9, wherein said restrictor means is at least in part formed from resilient material.

11. A snow ski of the type as claimed in claim 10, wherein said restrictor means comprises a disc which is located in said aperture, a slot in said disc through which said pin projects and wherein said disc is rotatable within said aperture between a first position whereby said slot is parallel to said elongate upper ski section and a second position whereby said slot is perpendicular to said elongate upper ski section.

12. A snow ski comprising:

a. an elongate lower ski section having a top surface and a bottom surface and two longitudinal space ends which at one of its two ends includes an upwardly curved ski tip, said lower ski section being generally flat and of uniform thickness along its length between its said ends;

b. an elongate upper ski section having an upper surface, a lower surface which is inwardly curved along its length and a ski boot fixation area, and wherein said lower surface of said upper ski section overlies in a preselected location the top surface of said lower ski section between said ends of the lower ski section;

c. connector means extending longitudinally along the lower surface of said upper ski section and the top surface of said lower ski section between its said ends for slidingly interconnecting the lower surface of said upper ski section to said top surface of said lower ski section and to thereby impart to said lower ski section a camber which compliments said inwardly curved lower surface of said upper ski section when said upper and lower ski sections are slidingly interconnected; and d. means for fixedly attaching said upper ski section to said lower ski section at said ski boot fixation area when said upper and lower ski sections are slidingly interconnected in said preselected location.

13. The snow ski as claimed in claim 12, wherein said connector means includes at least one slide rail which is fixed to and which extends centrally along and projects outwardly from one of the top surface of said lower ski section and the lower surface of said upper ski section, and an elongate slide rail receiving channel which extends centrally along and projects inwardly from the other of said top surface of said lower ski section and the lower surface of said upper ski section.

14. The snow ski as claimed in claim 13, wherein said at least one slide rail is fixed to said lower ski section.

15. The snow ski as claimed in claim 14, wherein said outwardly projecting slide rail and said slide rail receiving channel recess are T-shaped in cross section.

16. The snow ski as claimed in claim 15, wherein said upper and lower ski sections are captively held together in said preselected location by said connector means and by said means for fixedly attaching said upper ski section to said lower ski section.

17. The snow ski as claimed in claim 16, further including limit means on said upper and lower ski sections proximate at least one of the ends of said upper ski section for controlling the amount of relative sliding movement between said upper and lower ski sections along said connector means during longitudinal flexing of said snow ski.

18. The snow ski as claimed in claim 17, wherein said limit means includes an aperture in said upper ski section, a pin which projects upwardly from said lower ski section into said aperture, and restrictor means positioned between said pin and a sidewall of said aperture for restricting the relative movement of said pin within said aperture.

19. The snow ski as claimed in claim 18, wherein said restrictor means is at least in part formed from resilient material.

20. The snow ski as claimed in claim 19, wherein said restrictor means comprises a disk provided with a slot for receiving said pin, and wherein said disk is rotatable within said aperture about said pin between a first position whereby said slot is parallel to said elongate lower ski section and a second position whereby said slot is perpendicular to said elongate lower ski section.

21. The snow ski as claimed in claim 16, wherein said ski boot fixation area of said upper ski section has a width which approximates the width of the underlying lower ski section, said upper ski section further including intermediate sections located forward and rearward of said ski boot fixation area which each have a width less than said ski boot fixation area, and front and rear end sections at least a portion of each of which has a width greater than said intermediate sections.

22. The snow ski as claimed in claim 21, wherein at least part of said intermediate sections are raised relative to said front and rear end sections and said ski boot fixation area.

23. The snow ski as claimed in claim 22, wherein said upper ski section is tubular and includes internally thereof a centrally positioned elongate backbone.

* * * * *